United States Patent [19]

Brown et al.

[11] Patent Number: 4,457,434

[45] Date of Patent: Jul. 3, 1984

[54] APPARATUS FOR ORIENTING, SINGULATING AND SIZING MUSHROOMS AND LIKE OBJECTS

[75] Inventors: Gregory J. Brown; Meredith E. Smith Jr., Hasmukk T. Shah, all of San Jose, Calif.; Cecil D. Beadles. deceased, late of San Jose, Calif. by Nancy L. Beadles, executrix

[73] Assignee: FMC Corporation, Chicago, Ill.

[21] Appl. No.: 344,573

[22] Filed: Feb. 1, 1982

[51] Int. Cl.[3] ..... B07C 5/10

[52] U.S. Cl. ..... 209/539; 198/380; 209/543; 209/586; 209/906; 356/386; 406/88

[58] Field of Search ..... 209/538-539, 209/540, 543, 576, 586, 644, 906, 934, 541, 544, 932; 198/380, 493, 459, 456, 425; 406/87, 88, 89, 86; 356/386, 398

[56] References Cited

U.S. PATENT DOCUMENTS

| | | | |
|---|---|---|---|
| 2,744,609 | 5/1956 | Jenney et al. | 198/493 |
| 2,793,734 | 5/1957 | Lorenzen | 198/380 |
| 2,840,222 | 6/1958 | Palmer | 198/380 |
| 2,973,109 | 2/1961 | Gable | 198/380 |
| 3,075,625 | 1/1963 | Randall | 198/380 |
| 3,327,850 | 6/1967 | Simmons | 209/586 |
| 3,455,444 | 7/1969 | Simmons | 209/586 |
| 3,489,276 | 1/1970 | Fiore et al. | 209/543 |
| 3,549,008 | 12/1970 | Anderson | 209/586 |
| 3,590,993 | 7/1971 | Baker | 209/543 |
| 3,770,111 | 11/1973 | Greenwood et al. | 209/586 |
| 3,774,040 | 11/1973 | Stephanos | 209/586 |
| 3,955,678 | 5/1976 | Moyer | 209/934 |
| 4,120,403 | 10/1978 | Stephanos . | |
| 4,347,022 | 8/1982 | Lenhart | 406/88 |

OTHER PUBLICATIONS

"An Air Conveyor System for Fruits and Vegetables" by Ervin G. Humphries et al., Paper No. 77-1534 presented at the 1977 Winter Meeting of the American Society of Agricultural Engineers.

*Primary Examiner*—Robert B. Reeves
*Assistant Examiner*—Donald Hajec
*Attorney, Agent, or Firm*—Lloyd B. Guernsey; Henry M. Stanley; Richard B. Megley

[57] ABSTRACT

Apparatus for orienting and sorting mushrooms includes an inclined plate along which the mushrooms move, a tunnel for erecting an air dam in the path of movement of the mushrooms to singulate the mushrooms, and a photoelectric mechanism for sorting the mushrooms according to size.

10 Claims, 16 Drawing Figures

2
32
30
31
26
M
24
20
6
18
25
16
17
95
96
85
14
70
72
5
33
42
48
10
12
40

32
82
74
74a
84
10
20
24
26
22
18
33b
31
78
76
86
85
17
93
92
95
91
90
16
14
70
33a
33
80
M
46
52
69
65
54
56
58
42
48
64
59
68
50
43
62
12
40

APPARATUS FOR ORIENTING, SINGULATING AND SIZING MUSHROOMS AND LIKE OBJECTS

BACKGROUND OF THE INVENTION

1. Field of the Invention

The present invention generally relates to apparatus for sorting articles and in particular relates to an apparatus for sorting mushrooms or like articles which are generally symmetrical about an axis and are heavy at one end.

2. Description of the Prior Art

Presently, mushrooms are sorted manually either by those who pick the mushrooms or by workers at the packing where the mushrooms are packaged. Generally, the workers simply guess as to whether the mushroom falls in one of at least three size categories, large, medium, and small. It will be appreciated that it would be very advantageous to provide an apparatus for mechanically sorting the mushrooms, not only because mechanization would reduce labor costs, but also to eliminate the guess work in making the size classification.

However, mushrooms are relatively delicate and would be easily broken by conveying apparatus used for other produce and objects. That is to say, the mushrooms will break apart, for example, the caps will be broken from the stems of the mushrooms. Also, mushrooms cannot be handled in a moist environment because the mushrooms will decay and rot. Thus, a water handling system, such as used to handle delicate produce such as apples, cannot be employed in handling mushrooms. It is felt that none of the prior art conveying and sorting systems are adaptable to the sorting of mushrooms, and the present invention provides the first apparatus for mechanically sorting mushrooms according to size.

Air cushion conveyors are known in the prior art. In an American Society of Agricultural Engineers, Paper No. 77-1534, entitled "An Air Conveyor System For Fruits And Vegetables", an air conveyor system was described as consisting of a plenum and a slotted conveyor surface. In this paper, the conveyor surface was solid (that is, it was not perforated) and slots were formed in the rear end wall of the conveyor. Air is blown through this slot to convey the produce away from such slot.

The Randall U.S. Pat. No. 3,075,625 discloses an orienting apparatus for articles such as sliced food products which includes an inclined chute having a perforated bottom wall and vertical walls at the sides thereof which converge in the direction of the lower end of the chute. Air is blown upwardly through the perforated bottom wall, and as the air strikes the bottom of the article sliding down the chute, the air is deflected to the sides of the article and passes upwardly between the sides of the article and the converging side walls of the chute. This provides a cushioning effect which tends to center the article between the side walls.

In the fruit orienting mechanism of the Lorenzen U.S. Pat. No. 2,793,734, a conveyor includes a plurality of cups formed therein for receiving a single fruit in each cup. The cups include a conical wall force terminating at its upper end in a ring and at its lower end in an orifice. As shown in the drawings of this patent, the fruit (apple) is suspended in a stream of air flowing upwardly through the cup. Due to a drag force effect on a periphery of the fruit, the fruit rotates to a position such that its maximum diameter is in a plane essentially normal to the axial path of the air directed through the cup.

The Simmons U.S. Pat. No. 3,327,850, Moyer U.S. Pat. No. 3,955,678 and Stephanos U.S. 3,774,040 patents all deal with apparatus for grading articles according to size which utilize various photoelectric detectors and various control circuits associated with the detectors which cooperate to operate ejection apparatus to divert articles from a conveyor according to their size. It is also known that cameras are now available in the marketplace which incorporates a linear array of photo cells and circuitry to determine the size of an object moving past the camera. For example, the Reticon Corporation of Sunnyvale, Calif. manufactures an analog/digital line scan camera (Model LC64P) which can be thresholded to produce a digital output only when the article viewed by the camera is larger than a predetermined size.

The patents to Anderson U.S. Pat. No. 3,549,008, Simmons U.S. Pat. No. 3,327,850, Simmons U.S. Pat. No. 3,455,444, and Greenwood et al U.S. Pat. No. 3,770,111 disclose the combination of scanning means for measuring a physical characteristic with a selectively actuated air ejection system.

SUMMARY OF THE INVENTION

The present invention provides an apparatus for sorting objects that is adapted to handle articles such as mushrooms which are generally symmetrical about an axis and which have a maximum cross-sectional area in a plane which is normal to such axis, whereby the article may be oriented by an air stream. Briefly stated, the sorting apparatus of the present invention includes a downwardly inclined, perforated support plate, a blower for directing air upwardly through the support plate to cause the objects on the plate to be oriented generally vertically, and photoelectronic means including a photodiode and light source with either the photodiode or the light source being positioned below the support plate and the other one thereof being disposed above the plate and also above the objects. As the objects move in their oriented attitude over the support plate to a position between the array and light source, a signal is generated by the photodiode which is proportional to the size of the object. This signal is fed to a control circuit which in turn issues a signal to at least one ejection mechanism, such as an air ejector. Dependent on the size of the article, the air ejector is energized to divert the object from its path of travel or the object is permitted to continue along its path of travel.

To assure that the articles are fed in a single file, spaced apart relationship, an overhead diverter or tunnel is positioned at a necked-down area of the support plate to create an air cushion or dam in the path of the articles as they move under the diverter plate. Preferably, the end of the diverter which is adjacent the higher or upstream end of the support plate is upwardly inclined relative to the central portion of the diverter plate. Also, the end of the diverter plate, which is at the downstream end of the plate, is bent upwardly relative to the central portion thereof. The bending of the ends of the diverter plate causes an air flow pattern, hereinafter referred to as an air dam, which retards the flow of mushrooms below the upstream end of the plate and which accelerates the movement of the mushrooms below the downstream end of the plate. The retarding effect assures that only one or two mushrooms will pass at any time below the central portion of the plate. The accelerating effect produced at the downstream end of the plate causes the mushrooms to quickly accelerate and thereby separate from each other to a greater distance than would occur if the air dam effect was not induced by the plate. The air dam has been found to enhance the rate at which the articles can be oriented and singulated and also to assure that only one article at a time will be fed to the detection area.

It will thus be appreciated that the present invention provides, for the first time known to the present inventors, an apparatus which is capable of handling delicate decayable produce such as mushrooms in a manner which totally eliminates concern about breaking apart or abrading the produce. Moreover, since air is used as the suspension medium, the mushrooms can be handled without fear of rotting or decay as would be the case if water were used to carry the mushrooms. It will also be appreciated that even though the principle concern of the inventors in developing the present invention has been that of providing an apparatus for sorting mushrooms, the apparatus of the present invention will have applications in handling other produce or articles which are generally symmetrical about an axis so that they can be oriented by air flow.

DESCRIPTION OF THE PREFERRED EMBODIMENT

Figure 1:
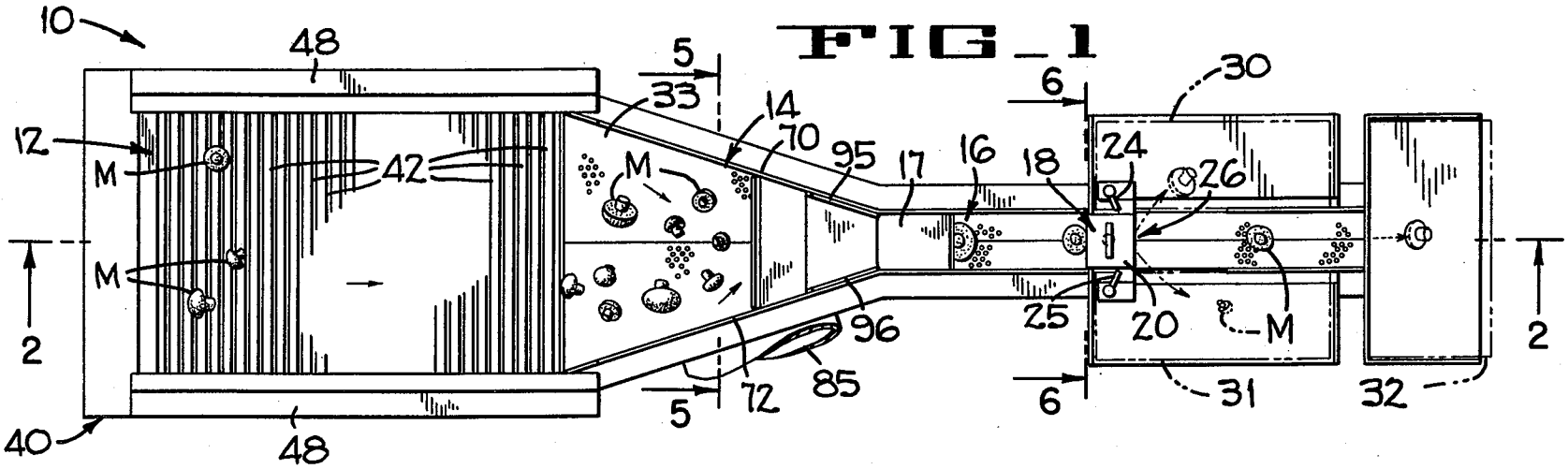
FIG. 1 is a top plan of the sorting apparatus of the present invention.
Figure 2:
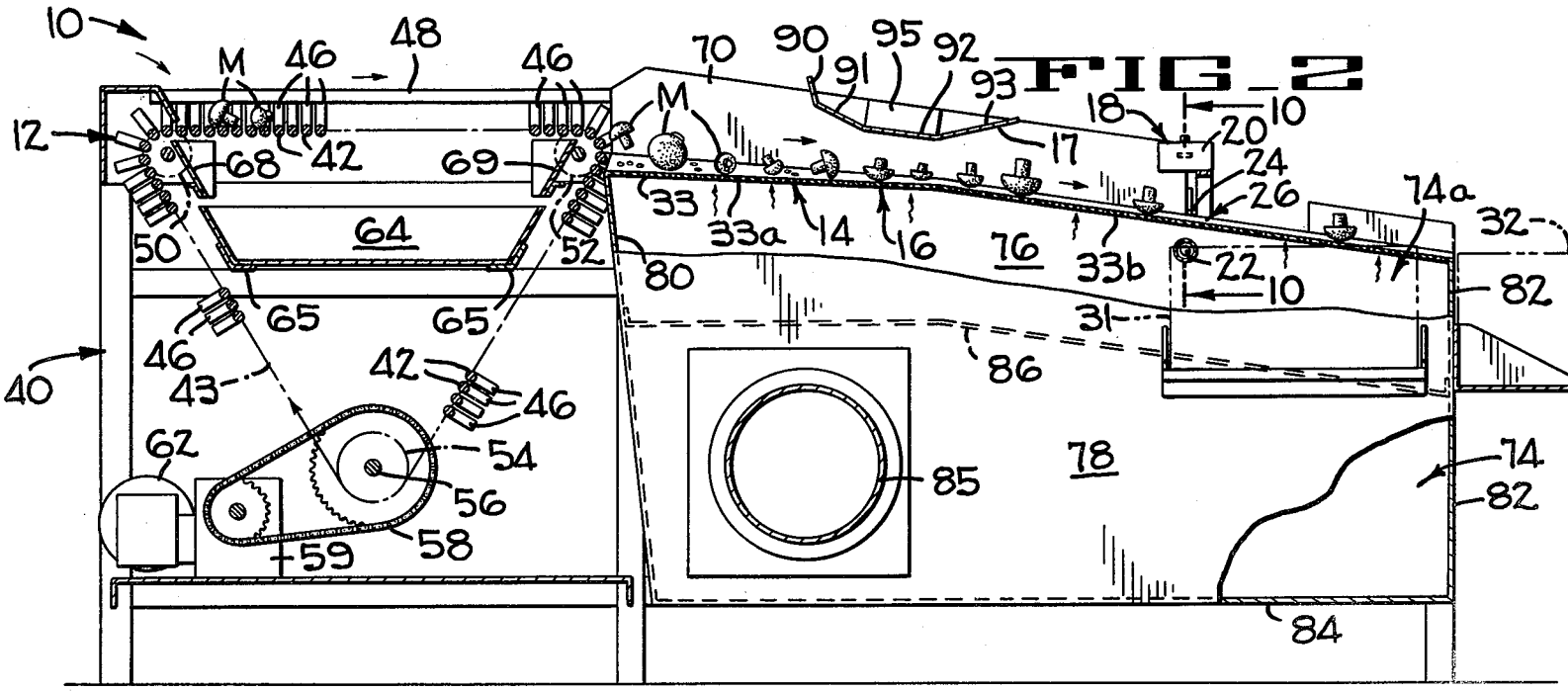
FIG. 2 is a section taken along line 2—2 of FIG. 1.

As illustrated in FIGS. 1 and 2, a sorting apparatus 10 for sorting mushrooms M into three size categories includes a feed conveyor 12, and an air cushion conveyor 14 which receives mushrooms in random orientations and at random feed rates from the feed conveyor 12. The air cushion conveyor includes an orienting and singulating section 16 at which the conveyor cooperates with an overhead restrictor or diverter plate 17 to first orient the mushrooms with their caps down and their bodies extending generally vertically upwardly and then singulated. After being singulated the mushrooms are fed to an inspection section 18. At the inspection section a photodetector 20 is positioned above the air cushion conveyor and a light source 22 is positioned below the photodetector and also below the stream of mushrooms. Air ejector nozzles 24 and 25 are located immediately downstream from the photodetector at a sorting station 26. Each of the ejector nozzles receives high pressure air from a suitable source such as a tank, and the actuation of each ejector is controlled by a solenoid-controlled valve in the line between the ejector and the pressurized source. As will be described in detail in connection with FIGS. 9-13, a control circuit is provided for receiving a signal from the photodetector and translating the signal into signals which operate solenoids 24A and 25A of valves in lines leading to the ejector nozzles 24 and 25, respectively, to either eject the mushrooms into bins 30 or 31 at the sides of the detecting and ejecting section, or to move them into a bin 32 positioned downstream of the air cushion conveyor. As previously stated, the orienting and sorting apparatus 10 is adapted to handle mushrooms without abrading them or without damaging the caps or breaking the stems from the caps of the mushrooms. It should be noted that mushrooms are generally symmetrical about an axis through their stem, that the cap end of the mushroom is heavier than the stem end, and that the cap itself is partially spherical in configuration. Due to the shape and weight distribution of mushrooms, it is possible to orient them by using air. When air is blown upwardly through a perforated wall that is generally horizontal but is inclined downwardly at a small angle, mushrooms on the wall will assume positions with their caps lowermost and their stems oriented upwardly, generally parallel to the air flow. The present invention takes advantage of this understanding of what happens when air is directed against randomly-oriented mushrooms. Particularly, the air cushioned conveyor 14 includes a perforated support plate 33, and air is blown upwardly through the perforated support plate to orient the mushrooms supported thereon. The mushrooms are thereafter singulated on the support plate as they slide along the surface of conveyor 14 and, at inspection section 18, the size of the mushrooms is detected by the photodetector while still supported on the perforated support member. Finally, the mushrooms are ejected into the bins 30-32 while still supported on the support member. It will thus be appreciated that the mushrooms are oriented, singulated and sized all while maintaining a minimum contact with the support plate, thus eliminating the concern about damage of the mushrooms. Having thus generally described the basic components of the sorting apparatus and having described the basic characteristics of the air cushion conveyor 14, the construction of the individual elements will be set forth. The feed conveyor 12 and the air cushion conveyor 14 are supported on a rigid frame 40 (FIG. 2). The feed conveyor includes an endless series of bars 42 that extend transversely in parallel spaced apart relationship. The bars are carried by two spaced chains 43 which are shown in phantom outline in FIG. 2. The bars are spaced from each other to permit dirt and fragments of previously broken mushrooms to fall through the spaces between the bars. Narrow metal plates 46 are secured to the ends of the bars to provide a side wall at the edges of the conveyor surface. When in the upper reach of the conveyor path, the upper ends of the plates 46 pass between the spaced, downwardly-extending walls of channels 48 at the sides of the feed conveyor. Each of the chains 43 is trained around three sprockets 50, 52, 54 to move through a triangular path arranged so that the reach of the conveyor which is situated between the sprockets 50 and 52 is horizontal. The two lower sprockets 54 are mounted on a drive shaft 56 that is driven by a chain 58 that, in turn, is entrained on the output sprocket of a speed reducer 59. The speed reducer, in turn, is driven by an electric motor 62 at a speed which will move the conveyor chain at a velocity of approximately 40 feet per minute. At this conveyor speed, mushrooms will be fed to the air cushion conveyor 14 at a rate of approximately 500 pounds of mushrooms per hour, which is equal to about 20,000 mushrooms per hour. When mushrooms are fed at this rate, the inspecting and sorting system is adapted to handle mushrooms at the rate of approximately 5 mushrooms per second.

A tray 64 (FIG. 2) is positioned below the upper reach of the conveyor 14, being slidably supported in upwardly-opening shallow channels 65 that are fixed to the frame 40 to extend transversely under the upper run of the conveyor. To direct debris into the tray, inclined walls 68 and 69 are secured below the upper reach of the conveyor at positions adjacent the sprockets 50 and 52 respectively.

The air cushion conveyor 14 shall be described in connection with FIGS. 1–6. Generally, the air cushion conveyor includes the perforated support plate 33, side walls 70 and 72 disposed at the sides of the conveyor, and a plenum chamber 74 below the perforated support plate 33 which forms the upper wall of the plenum chamber. The plenum chamber is defined by side walls 76 and 78 (FIG. 6), an upstream end wall 80 (FIG. 2), a downstream end wall 82, and a bottom wall 84. An air inlet opening is formed in the side wall 78 of the plenum chamber, and a duct 85 communicates with this opening directing air into the plenum chamber. The duct is connected to a blower which may be a high capacity centrifugal type. Air is blown into the plenum chamber and upwardly through perforations in an intermediate equalizer plate 86. The plate 86 controls the distribution of air into the upper portion 74*a* of the plenum chamber 74 so that air is expelled evenly through the perforations in the support plate 33.

It is noted at this point that the perforated support plate 33 is so thin that the openings therein do not produce laminer air flow or any other particular type of air flow. For example, the support plate may be formed from 26 gage aluminum having 0.033" diameter circular openings therein which are closely spaced in a square pattern to provide a screen surface that has approximately 26% open area.

Figure 4:
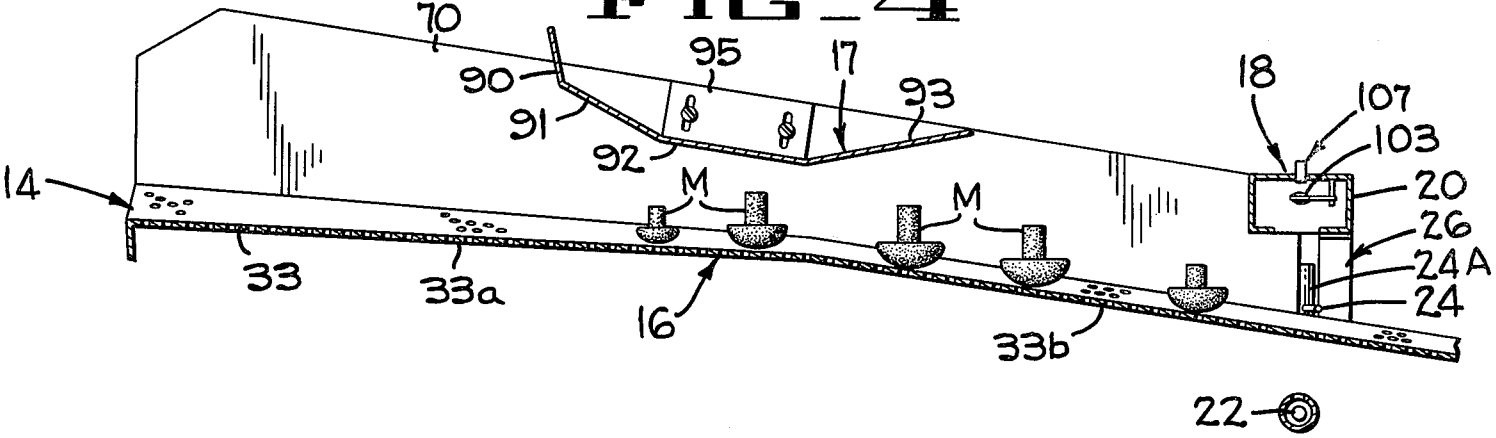
FIG. 4 is a section taken on line 4—4 of FIG. 3
Figure 3:
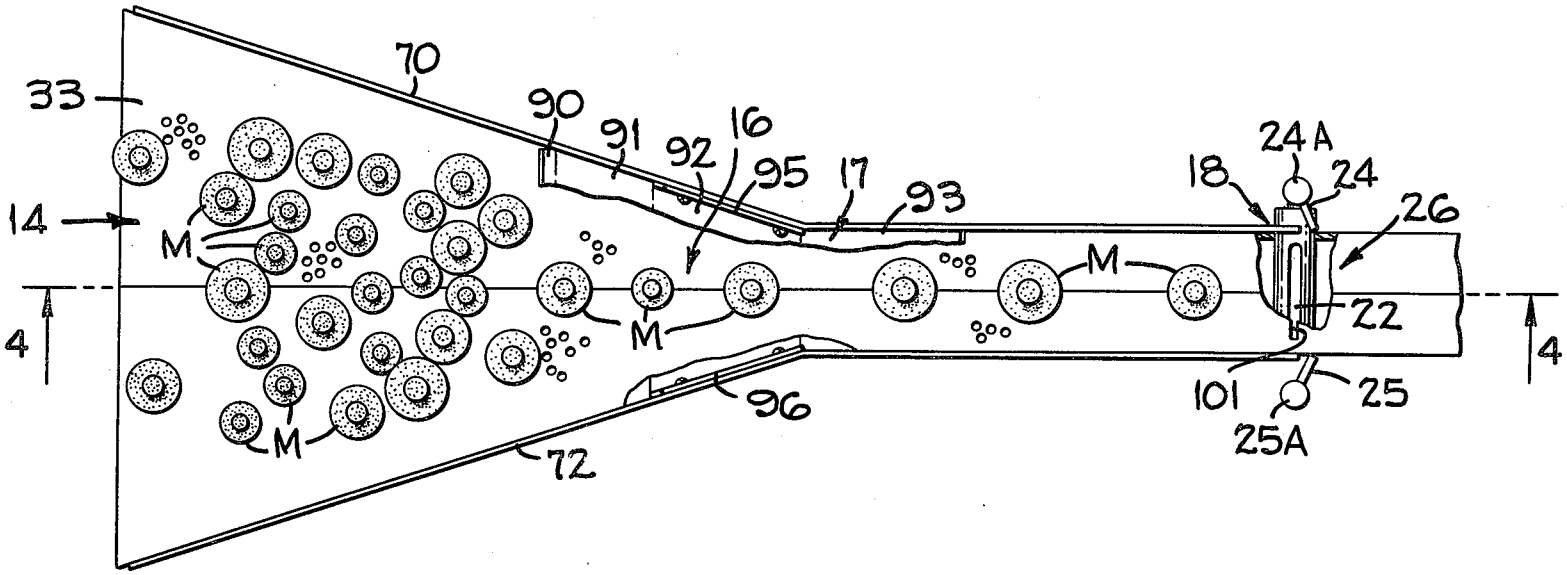
FIG. 3 is an enlarged plan of a portion of FIG. 1, with parts broken away.
Figure 5:
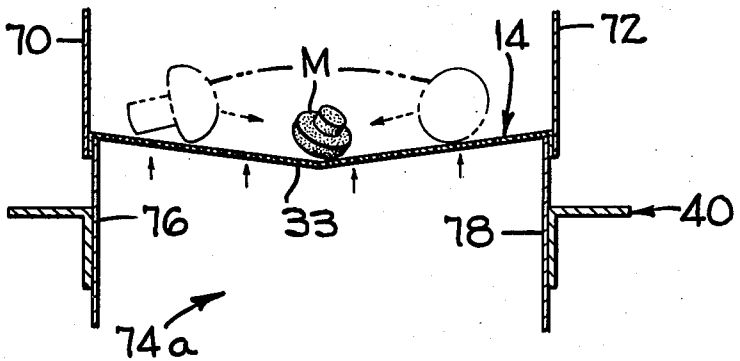
FIG. 5 is an enlarged transverse section taken on line 5—5 of FIG. 1.
Figure 7:
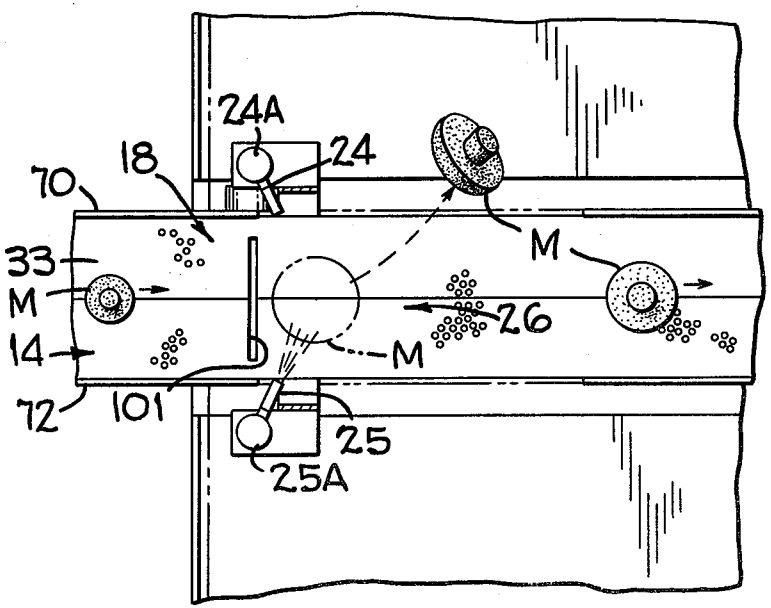
FIG. 7 is an enlarged, fragmentary, top plan view of the portion of the sorting apparatus which surrounds the detection area.
Figure 6:
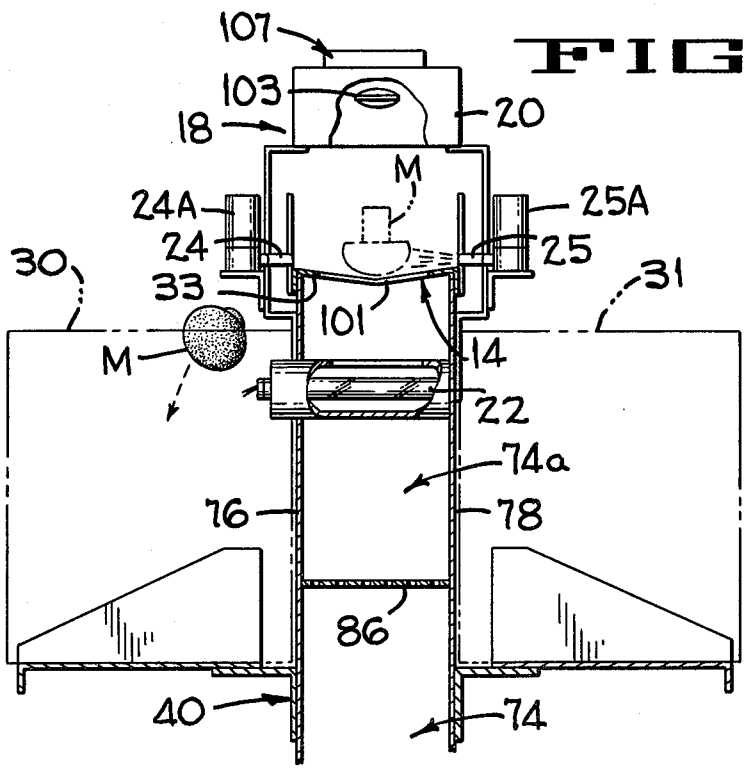
FIG. 6 is an enlarged section taken along line 6—6 of FIG. 1.

Referring to FIG. 5, it will be seen that the support plate 33 defines a shallow V in cross-section and is symmetrical about a vertical plane that extends longitudinally through the center of the support plate. This concave contour causes the mushrooms to move toward the low spot at the center of the support plate. The angle between the upwardly sloping portions of the support plate is approximately 160° so that the mushrooms on each side of the plate are urged down a 10° incline toward the center of the plate. As shown in FIG. 4, the support plate has a leading section 33*a* disposed at an angle inclined at about 4° to the horizontal, and an adjacent section 33*b* that is inclined about 9° to the horizontal. Thus, when air is blown upwardly through the support plate, the mushrooms become generally vertically oriented and are either suspended above the support plate in close proximity thereto or touch the plate with only a very minimal drag thereon. Thus, when mushrooms are fed to the upstream higher end 33*a* of the support plate, they are in random orientations, but soon thereafter the stream of air moving upwardly through the support plate turns the mushrooms into cap down orientations. In such orientations the mushrooms move relatively freely down the support plate due to the slope of the plate and the urging of the conveyor 12. The restrictor plate 17 (FIGS. 3 and 4) comprises a member which may be made of clear plastic plates about $\frac{1}{8}$ inch thick and has four sections 90–93 which cooperate with the side walls 70 and 72 of the air conveyor to define a tunnel. Section 90 at the entrance end of the tunnel is disposed at a rather steep angle relative to the plane of the support plate 33. The next section 91 is not inclined so steeply, and section 92 is generally parallel to the support plate 33. The trailing section 93 is inclined upwardly as shown in FIG. 4. A pair of tabs 95 and 96 which extend upwardly from the side edges of section 92, are provided with slots, and the tabs are secured to the side walls 70 and 72 by screws extending through the slots and into the side walls to support the restrictor plate above the conveying surface.

At the inspection station 18 (FIG. 10) the mushrooms are scanned by a narrow ribbon of light projected upward from the light source 22 through a slit 101 in the plate 33 and focused by a lens 103 as a ribbon of light which falls on a plurality of photodiodes 107 arranged in a strip across the housing of the inspection station. When there are no mushrooms between the light source 22 and the photodiodes 107 each of the photodiodes are rendered conductive. When a mushroom M covers the slit 101 in the plate 33, the number of the photodiodes 107 in the shadow cast by the mushroom is directly proportional to the diameter of the mushroom.

Figure 8:
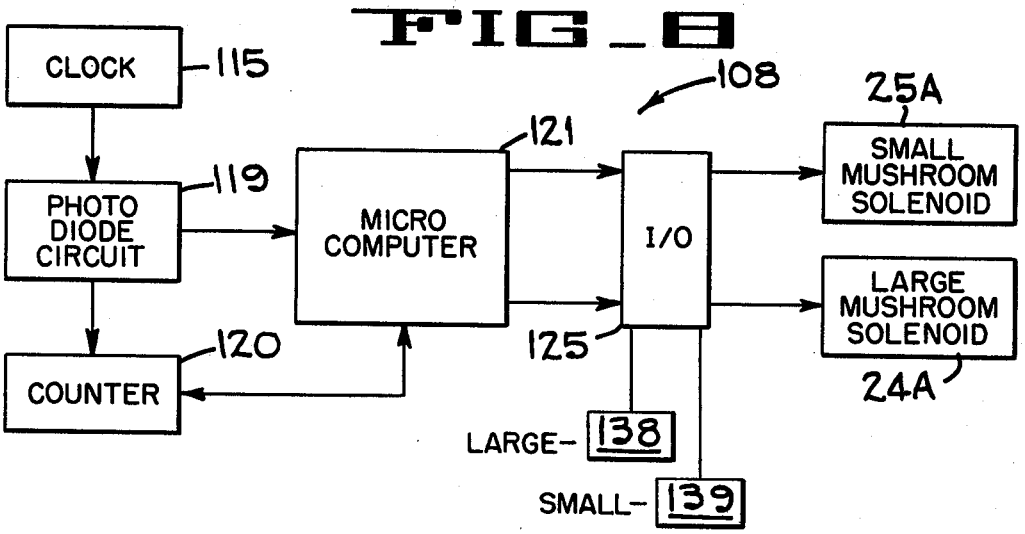
FIG. 8 is a block diagram which illustrates the control circuitry of the sorting apparatus.
Figure 10:
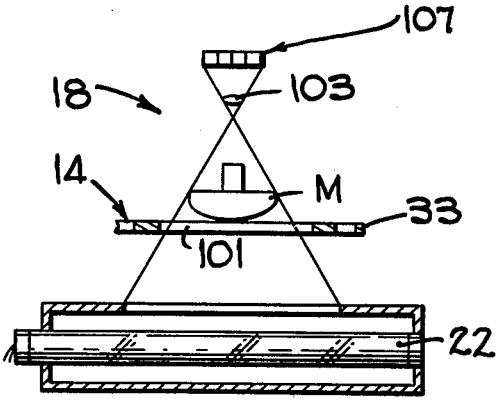
FIG. 10 is an enlarged vertical section taken along the line 10—10 of FIG. 2 illustrating operation of the photodetector of the mushroom sizing detector.
Figure 11:
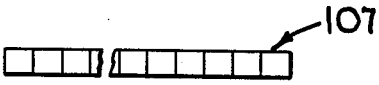
FIG. 11 is an enlarged drawing of the diode array portion of FIG. 10.
Figure 12:
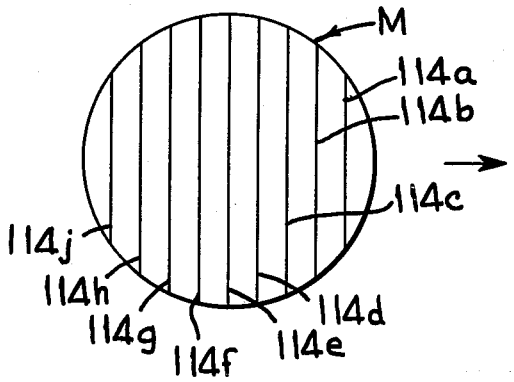
FIG. 12 is a bottom plan view of a mushroom, illustrating the light pattern at several positions along the conveyor.

A mushroom sizing circuit 108 (FIG. 8) periodically checks the length of the mushroom shadow which is cast on the photodiodes 107 (FIG. 10) several times as the mushroom moves over the slit 101, and uses the length of the longest shadow to determine the diameter of the mushroom. When the front edge of the mushroom M (FIG. 12) covers the slit 101 (FIG. 10) a narrow ribbon of light 114*a* (FIG. 12) falls on the lower end of the mushroom M and a corresponding shadow falls on the photodiodes 107. A clock 115 in the sizing circuit 108 (FIG. 8) produces a clock pulse which causes each of the illuminated photodiodes 107 in a photodiode circuit 119 to send a signal pulse to a pulse counter 120. The pulse counter 120 provides pulse count to a microcomputer 121 which uses the pulse count to determine the length of the light ribbon 114*a*. The next clock pulse from the clock 115 causes the photodiode circuit 119 and the counter 120 to send a second pulse count to the microcomputer 121. The microcomputer determines the length of the light ribbon 114*b* and checks the length of light ribbon 114*b* against the length of light ribbon 114*a*. The length of the longer of these two ribbons is retained in the computer 121 and compared against the length of the next light ribbon 114*c*. This process is repeated until the length of the longest of the light ribbon 114*a*–114*j* is determined and the length of the longest light ribbon falling on the ribbon is compared against a pair of predetermined values to decide if the mushroom is large, medium or small in size. If the mushroom is smaller than a predetermined size, the computer 121 provides a signal which causes an input/output circuit 125 to provide a sort signal to the solenoid 25A of air ejector 25, and discharges the small mushroom into the bin 30 at the side of the conveyor 14. If the mushroom is larger than a predetermined size, the computer 121 provides a signal which causes the input/output circuit 125 to provide a sort signal to the solenoid 24A of ejector 24 which discharges the large mushroom into the bin 31 on the other side of the conveyor 14. If the mushroom is of medium size it proceeds to the end of the conveyor where it is discharged into the bin 32.

Figure 9A:
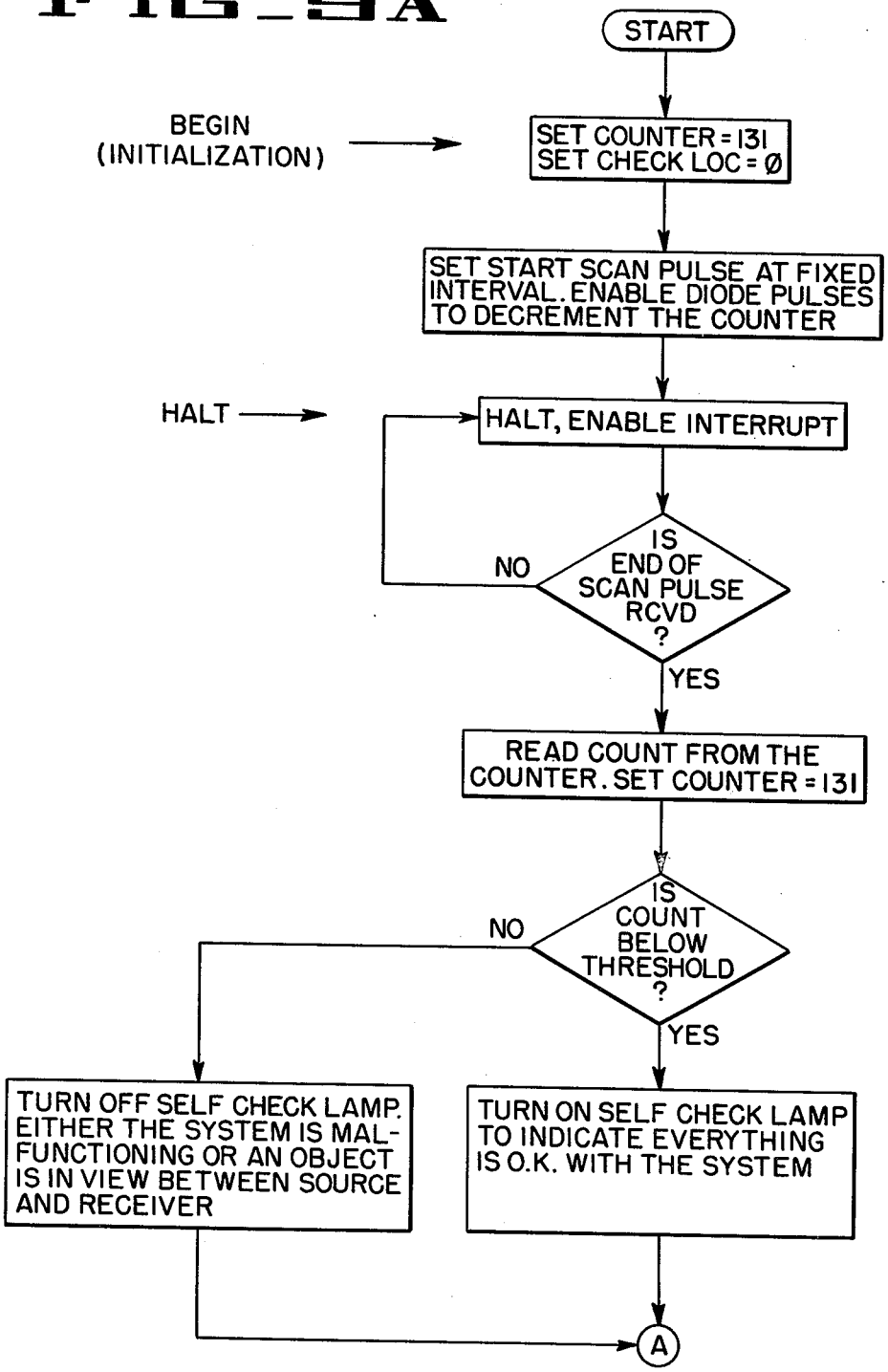
FIGS. 9A-9B make up a software flow chart to be used in developing a program for the microprocessor of the control circuit.
Figure 9B:
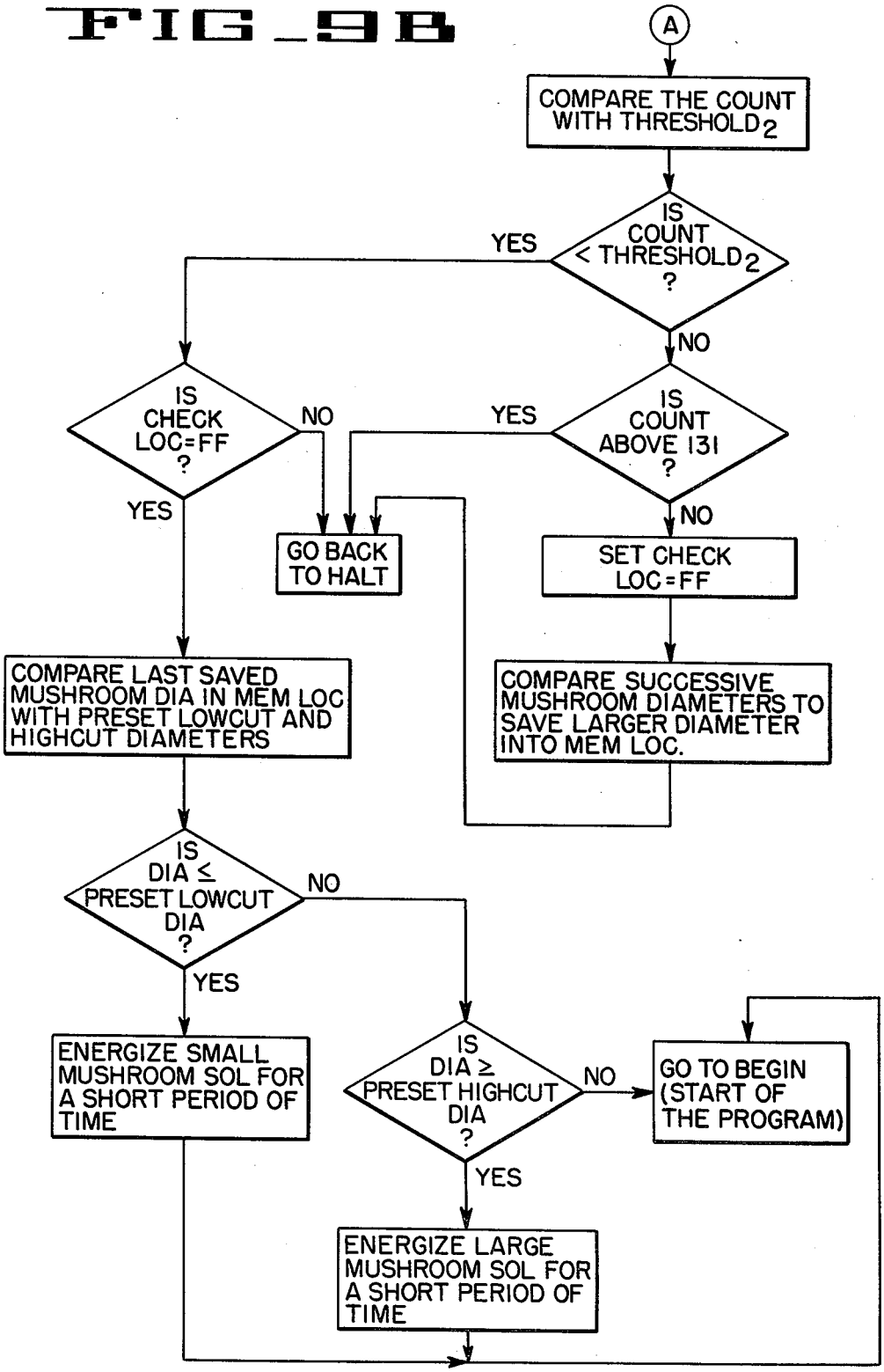
Figure 13A:
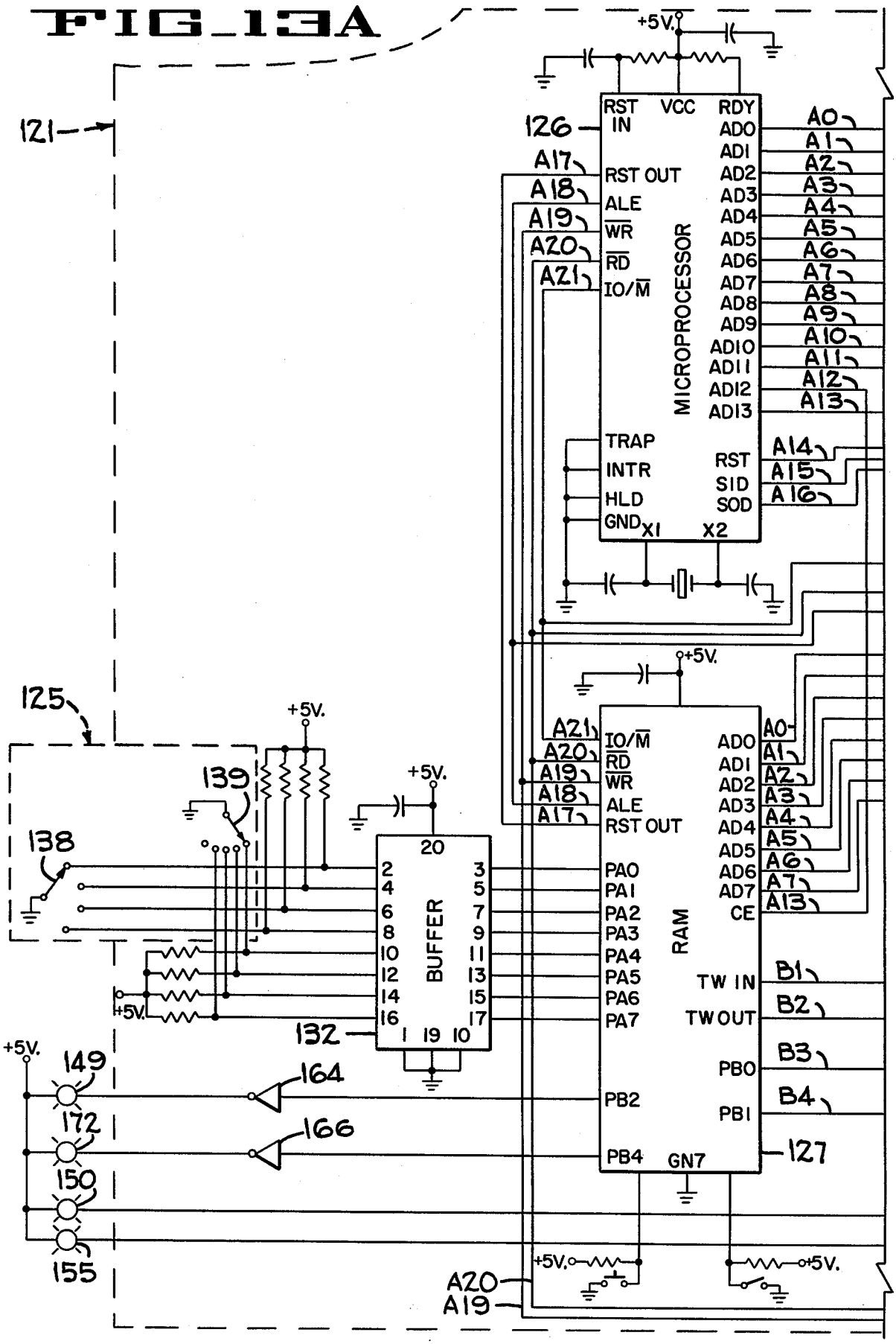
FIGS. 13A-13C, when combined, form a schematic drawing of the electronic sizing circuit which sorts the mushrooms into several sizes.
Figure 13B:
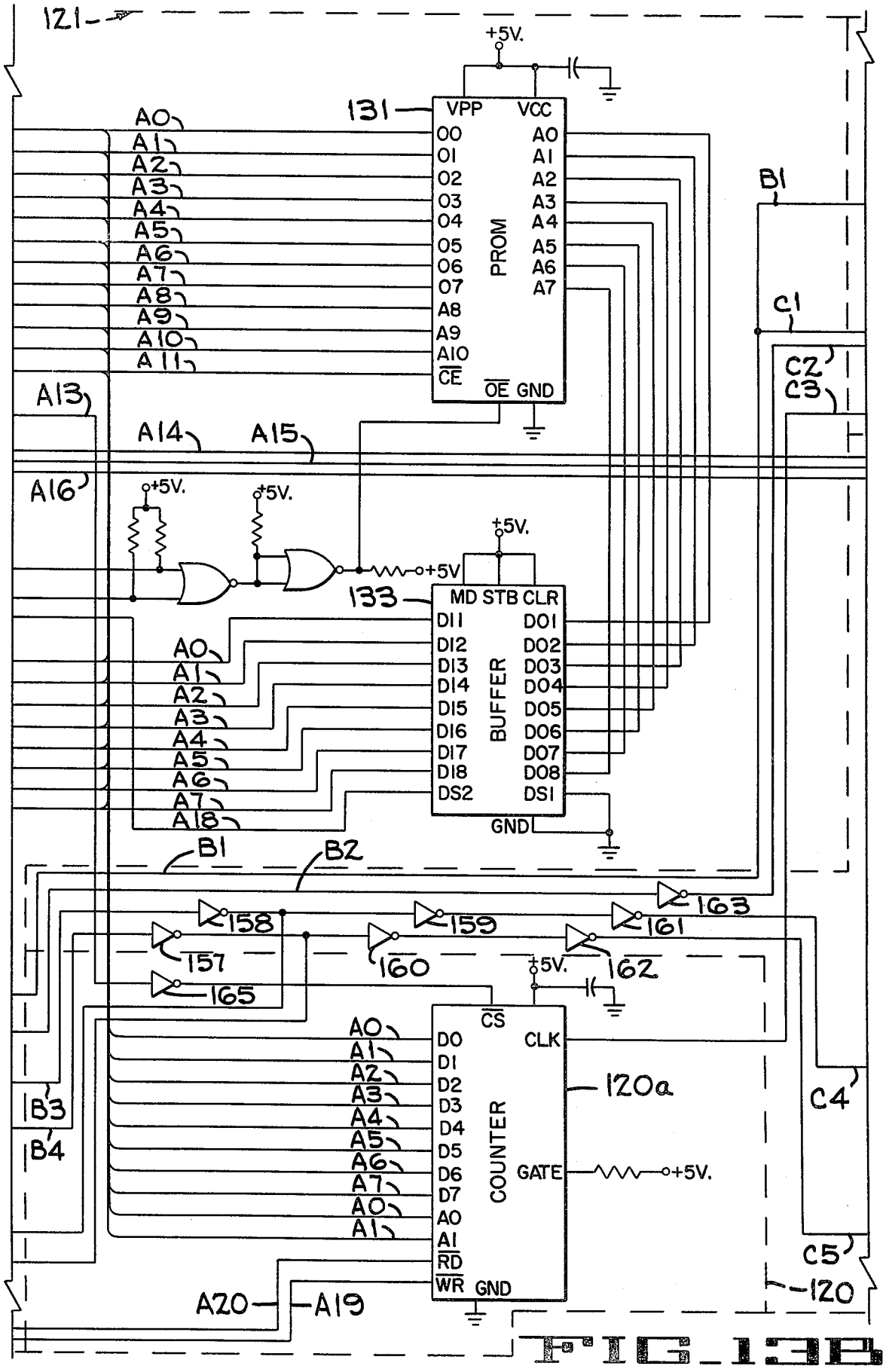
Figure 13C:
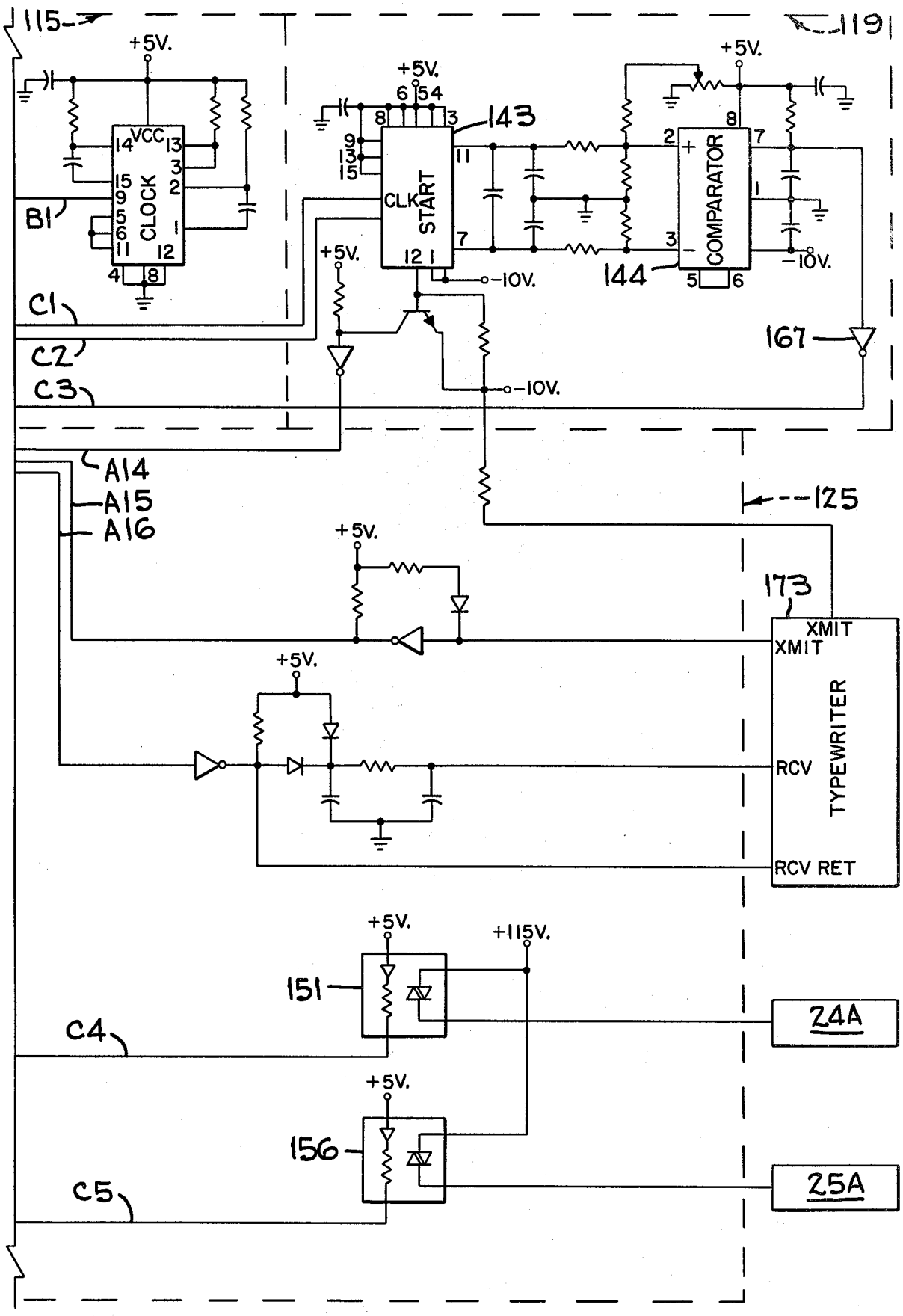

Details of the sizing circuit 108 are shown in FIGS. 13A, 13B, 13C and the sequence of operation of the sizing circuit are shown in FIGS. 9A–9B. When FIGS. 13A–13C are placed side-by-side with FIG. 13A on the left, 13B in the center and 13C on the right, lines from the right side of FIG. 13A are to be connected to the lines from the left side of FIG. 13B and lines from the right side of FIG. 13B are to be connected to lines from the left side of FIG. 13C to form a complete sizing circuit. Lines extending from one of the FIGS. 13A–13C to another of the FIGS. 13A–13C are labelled with corresponding numbers.

The microcomputer 121 (FIGS. 8, 13A, 13B) includes a microprocessor 126, such as the 8085 by Intel Corporation, Santa Clara, Calif. a random access memory (RAM) 127, such as the 8156 by Intel, a programmable read only memory (PROM) 131, such as the 2716 by Intel; and a pair of buffers 132, 133, such as the 81LS98 by National Semiconductor Corporation, Santa Clara, Calif. and the 8212 by Intel, respectively. A program for directing operation of the microcomputer 121 is stored in the PROM 131 and the program is recalled, one step at a time by the microprocessor 126 to provide scanning of mushrooms as they pass over the lit 101 (FIG. 10) in the conveyor 14. The microprocessor 126 recalls the program by sending PROM address signals to the buffer 133 which stores the address signals for use by the PROM. The stored address signals cause the PROM 131 to send program signals directly to the microprocessor 126. The program causes data from the photodiode circuit 119 to be stored in the RAM 127 (FIG. 13A) and causes the lengths of shadows cast on the photodiodes 107 (FIG. 10) to be compared with predetermined standard shadow length to make decisions as to small, medium and large mushroom sizes. Signals which represent the "cut points" of sizes for small and large mushrooms are provided by a pair of cut point selector switches 138, 139 (FIG. 13A) and coupled through the buffer 132 to the RAM 127.

The clock 115 (FIG. 13C) includes a semiconductor clock generator 139, such as the 9602 made by Fairchild Semiconductor, Mountain View, Calif. The clock 115 supplies clock pulses to operate the counter 120 (FIG. 13B) and the photodiode circuit 119. The counter 120 may be one of several types, such as the 8253 made by Intel. The photodiode circuit 119 includes a diode array 143 and a comparator 144. The diode array 143 includes the photodiodes 107 (FIG. 10) and associated circuitry in a semiconductor chip, such as the RL128G made by Reticon Corporation, Sunnyvale, Calif. The diode array 143 provides a series of output pulses in response to input clock pulses, with one output pulse for each of the photodiodes 107 that is energized by light. The output pulses from the array 143 are compared with a standard signal by a comparator 144 to eliminate the effect of noise pulses and to eliminate the effect of pulses caused by a leakage current in diodes of the array 143. One such comparator which can be used is the LM311 by National Semiconductor Corporation. The standard voltage for the comparator is provided by a potentiometer 145 which is connected to a +5 volts.

The operation of the sizing circuit will now be described in connection with FIGS. 9A, 9B, 13A, 13B and 13C. The sequence of operation is controlled by the program in the PROM 131 which begins by causing the processor 126 to send a signal to the chip select input $\overline{CS}$ of the counter **120*a* which sets the counter count to the number 131. The processor then causes the diode array to scan along the diodes 107 (FIG. 10) which sequentially produces a signal pulse for each diode which is exposed to light. The signal pulses decrement the counter 120 by a count of one for each diode signal pulse and the final count for the first scan is stored in the RAM 127. The diode scan is repeated at fixed intervals of time to provide mushroom diameter measurement to the computer. At the end of each scan the final counter reading is compared with a first threshold count to determine if the system is working. If the system is working and if no object is blocking the path between the light and the photodiode circuit a "self check" lamp 149 is energized. The final counter reading is compared with a second threshold signal to determine if a mushroom is in view. If a mushroom is in view of the diode array, a comparison of successive diameters at each scan takes place. After each scan the counter reading is compared with the count of the previous scan and the larger count, which represents a larger light ribbon 114*a*–114*j* on the mushroom and a larger shadow on the photodiodes, is saved in the RAM 127. When the largest count (largest ribbon length 114*a*–114*j*) for a given mushroom is ascertained, this is compared with a pair of present cutoff values from selector switches 138, 139 (FIG. 13A) and the processor 126 decides if the mushroom is a small, medium or large mushroom. If the mushroom is large the RAM 127 provides an output signal on terminal PBO which energizes a lamp 150 and energizes a solid state relay 151 which activates the large solenoid 24A of ejector 24 (FIGS. 1, 8, 13C) which releases air to blow the mushroom off one side of the conveyor. If the mushroom is small the RAM 127 provides an output signal on the PBl terminal which energizes a lamp 155 and a solid sate relay 156 causing the solenoid 25A to actuate ejector 25 to blow the mushroom off the other side of the conveyor. A plurality of inverters 157–167 (FIGS. 13A, 13B) provide amplification and proper signal phase for the various relays, lamps and other devices. If the mushroom is of medium size neither of the solenoids of ejectors 24 or 25** are activated and the mushroom proceeds to the end of the conveyor where it is discharged into a container.

A status lamp 172 can be used to provide other information to an operator if desired. The processor 126 can also be programmed to provide a total of the number of small, medium and large mushrooms to a teletypewriter 173 or other recording device and can receive instructions from the device. The teletypewriter is an optional device which can be omitted if a count of the mushrooms is not needed.

From the foregoing description it will be apparent that the present invention provides an effective means for gently manipulating a mass of mushrooms to form them into single file so that they can be accurately sorted according to size. The unique mechanism for erecting an air dam in the path of the forwardly moving mushroom provides a mushroom-singulating mechanism that is particularly effective to cause the relative movement of adjacent upright mushrooms into a single-file orientation while maintaining their upright orientation. The present invention can also be used to manipulate other articles having a generally circular or eliptical shape and sort them according to size.

Although the best mode contemplated for carrying out the present invention has been herein shown and described, it will be apparent that modification and variation may be made without departing from what is regarded to be the subject matter of the invention.

It is claimed:

1. In an article sorting system, means for conveying articles in a predetermined direction including a perforated plate for supporting the articles, means for directing air against the underside of the articles to reduce the frictional engagement of said plate with articles moving therealong, said plate having a section of reduced width, tunnel means for restricting the upward flow of air at said reduced section to form a mass of air in the path of movement of articles traveling along said section of conveying means, said tunnel means including an upper imperforate wall having a central section oriented substantially parallel to said plate and an entrance wall inclined downwardly toward said plate.

2. The system of claim 1 wherein said upper wall includes an upwardly sloping section connected to the downstream edge of said central section.

3. The system of claim 1 wherein said conveying means includes a side wall connected to and projecting upwardly from each side edge of said perforated wall, and said tunnel comprises an imperforate plate secured between said side walls.

4. The sorting system of claim 1 further including means for scanning articles carried in single file on said perforated plate.

5. The system of claim 4 further including a diverter mechanism responsive to said scanning means for diverting articles in selected directions from said plate.

6. The system of claim 1 including a light projecting means positioned on one side of the path of movement of articles moving along said support plate and arranged to direct a beam of light onto each article as it moves along said support wall, light-receiving means disposed on the opposite side of the articles moving along said support wall and adapted to receive a portion of the light beam that is not intercepted by the article, and means responsive to the amount of light received by said light-receiving means for actuating said diverter mechanism.

7. The system of claim 1 including a plurality of photodiodes mounted adjacent the path of movement of articles moving along said support plate;

a light source mounted adjacent said path opposite said photodiodes, said source directing a light beam across said path toward said photodiodes, the number of photodiodes receiving light from said source being determined by the size of an article between said source and said photodiodes;

means for using the number of photodiodes receiving light from said source to develop a signal determined by the size of the article between said source and said photodiodes; and means for using said signal from said photodiodes to divert the article from said path into one of a plurality of locations according to the size of the article.

8. Apparatus for sorting as defined in claim 7 including means for periodically determining the diameter of a portion of the article adjacent said photodiodes, and means for using the largest diameter of a plurality of said portion to develop said signal which diverts the article from said path to a location determined by the diameter of the article.

9. Apparatus as defined in claim 7 wherein said photodiodes are aligned in an elongated strip and a narrow ribbon of light is projected from said light source to all of said photodiodes with an absence of articles between said source and said strip of photodiodes, and light is received by a lesser number of said photodiodes when an article is present between said source and said photodiodes.

10. Apparatus as defined in claim 9 including computer means for checking the number of photodiodes which receive light from said source and for using said number to determine the size of an article adjacent said photodiodes.

* * * * *

UNITED STATES PATENT AND TRADEMARK OFFICE

CERTIFICATE OF CORRECTION

PATENT NO. : 4,457,434

DATED : JULY 3, 1984

INVENTOR(S) : GREGORY J. BROWN ET AL

It is certified that error appears in the above—identified patent and that said Letters Patent is hereby corrected as shown below:

On 1st page of the Letters Patent one of the Inventor's first name is misspelled - change as follows:

Change "Hasmukk T. Shah" to --Hasmukh T. Shah--.

Signed and Sealed this

*Twelfth* Day of *March 1985*

[SEAL]

*Attest:*

DONALD J. QUIGG

*Attesting Officer* *Acting Commissioner of Patents and Trademarks*